US005364747A

United States Patent [19]

Edwards et al.

[11] Patent Number: 5,364,747

[45] Date of Patent: Nov. 15, 1994

[54] COLOR CORRECTING LAYERS CONSISTING ESSENTIALLY OF AT LEAST ONE DYE-FORMING COUPLER AND GELATIN IN CHROMOGENIC BLACK-AND-WHITE PHOTOGRAPHIC IMAGING SYSTEMS

[75] Inventors: James L. Edwards, Rochester; Paul T. Hahm, Hilton; Joseph E. LaBarca, Rochester, all of N.Y.

[73] Assignee: Eastman Kodak Company, Rochester, N.Y.

[21] Appl. No.: 981,567

[22] Filed: Nov. 25, 1992

[51] Int. Cl.[5] ..... G03C 1/46

[52] U.S. Cl. ..... 430/504; 430/356; 430/364; 430/365; 430/402; 430/549; 430/565

[58] Field of Search ..... 430/504, 356, 364, 365, 430/402, 549, 565, 359

[56] References Cited

U.S. PATENT DOCUMENTS

| | | | |
|---|---|---|---|
| 1,996,928 | 4/1935 | Mannes et al. | 430/543 |
| 2,186,736 | 1/1940 | Schneider et al. | 430/376 |
| 2,592,514 | 4/1952 | Harsh | 430/365 |
| 2,628,902 | 2/1953 | Raibourn | 430/365 |
| 2,689,180 | 9/1954 | Friedman | 430/236 |
| 3,497,350 | 2/1970 | Yutzy et al. | 430/359 |
| 3,615,509 | 10/1971 | Klein et al. | 430/457 |
| 3,674,490 | 7/1972 | Madejec | 430/376 |
| 3,695,882 | 10/1972 | Kumai et al. | 430/15 |
| 3,798,037 | 3/1974 | Silverman | 430/506 |
| 4,052,213 | 10/1977 | Credner et al. | 430/443 |
| 4,118,228 | 10/1978 | Corluy et al. | 430/367 |
| 4,126,461 | 11/1978 | Pupo et al. | 430/402 |
| 4,137,080 | 1/1979 | Fujiwhara et al. | 430/402 |
| 4,200,466 | 4/1980 | Fujiwhara et al. | 430/566 |
| 4,273,861 | 6/1981 | Shiba et al. | 430/549 |
| 4,315,069 | 2/1982 | Scott et al. | 430/365 |
| 4,345,023 | 8/1982 | Wyckoff | 430/364 |
| 4,348,748 | 9/1982 | Scheerer et al. | 430/505 |
| 4,368,255 | 1/1983 | Borg | 430/351 |
| 4,436,798 | 3/1984 | Shennan et al. | 430/17 |
| 4,609,620 | 9/1986 | Postle et al. | 430/554 |
| 4,791,049 | 12/1988 | Kojima et al. | 430/544 |
| 4,946,765 | 8/1990 | Hahm | 430/505 |
| 4,971,869 | 11/1990 | Plummer | 430/7 |
| 5,141,844 | 8/1992 | Lau | 430/548 |

FOREIGN PATENT DOCUMENTS

| | | |
|---|---|---|
| 0025775 | 3/1981 | European Pat. Off. . |
| 0244356 | 11/1987 | European Pat. Off. . |
| 0321401 | 6/1989 | European Pat. Off. . |
| 0341204 | 11/1989 | European Pat. Off. . |
| 1291983 | 3/1962 | France . |
| 2250137 | 7/1975 | France . |
| 2269737 | 11/1975 | France . |
| 537923 | 11/1931 | Germany . |
| 743341 | 12/1943 | Germany . |
| 3307506 | 9/1984 | Germany . |
| 56133-733 | 3/1980 | Japan . |
| 61-056347 | 3/1986 | Japan . |
| 61-129640 | 6/1986 | Japan . |
| 1065-552 | 9/1987 | Japan . |
| 1179-143 | 1/1988 | Japan . |
| 63-110451 | 5/1988 | Japan . |
| 2008-839 | 6/1988 | Japan . |
| 63-236034 | 9/1988 | Japan . |
| 01179143 | 7/1989 | Japan . |
| 03107144 | 5/1991 | Japan . |
| 492518 | 1/1937 | United Kingdom . |
| 490517 | 8/1938 | United Kingdom . |
| 1160525 | 8/1969 | United Kingdom . |
| 1210417 | 10/1970 | United Kingdom . |

OTHER PUBLICATIONS

Patent Abstracts of Japan, vol. 015, No. 301, Jul. 1991, & JP 31 05 341 (Abstract).

Patent Abstracts of Japan, vol. 015, No. 305, Aug. 1991, & JP 31 07 144 (Abstract)

*Primary Examiner*—Charles L. Brown, Jr.

*Assistant Examiner*—Geraldine Letscher

*Attorney, Agent, or Firm*—Paul A. Leipold

[57] ABSTRACT

The invention is accomplished by forming balanced cyan, magenta, and yellow coupler and emulsion mixes. There is at least one layer in which silver halide emulsion has been sensitized to blue light or silver halide emulsion sensitive to green light. Regardless of the color sensitivity of the silver halide layer that contains silver contains a mix of cyan, magenta, and yellow dye-forming couplers. Further, in order to have a black-and-white image that has a lightness such as observed by the human eye in a scene, it is preferred that the ratios of red sensitive emulsion to green sensitive emulsion to blue sensitive emulsion in the photographic element is about 2:3:1.

16 Claims, 3 Drawing Sheets

COLOR CORRECTING LAYERS CONSISTING ESSENTIALLY OF AT LEAST ONE DYE-FORMING COUPLER AND GELATIN IN CHROMOGENIC BLACK-AND-WHITE PHOTOGRAPHIC IMAGING SYSTEMS

FIELD OF THE INVENTION

This invention relates to the formulation of a photographic system which produces black-and-white images using a combination of cyan, magenta, and yellow dyes. The dyes are formed during a color development step from a mixture of cyan, magenta, and yellow dye forming couplers which, when allowed to react with oxidized color developer, form a neutral image.

Background of the Invention

Black-and-white images formed in a photographic process are generally produced by developing silver halide in a black-and-white developer to form a silver image. A black-and-white developer, such as hydroquinone, is commonly used to reduce the exposed silver halide to silver metal. The undeveloped silver halide is removed from the print by 'fixing' with aqueous sodium thiosulfate. The silver metal remaining in the print represents the image.

In the photographic industry, a photofinisher who wishes to produce both black-and-white and color pictures or prints must have separate processing systems; one for color and one for black-and-white, as the two systems are not compatible. It would, therefore, be advantageous for the photofinisher to have one process capable of producing either black-and-white or color materials.

U.S. Pat. No. 4,348,474—Scheerer discloses a system wherein black-and-white images are formed by the use of one emulsion that is treated with three sensitizing dyes.

U.S. Pat. No. 2,186,736—Schneider discloses the use of several color components in one layer for a black-and-white image formation.

U.S. Pat. No. 2,592,514—Harsh discloses a color film in which couplers forming more than one color are present in the same layer of the color film.

U.S. Pat. No. 5,141,844—Lau discloses the use of polymeric dye-forming couplers that are comonomers of magenta dye forming couplers, yellow dye forming couplers, and cyan dye forming couplers.

The Eastman Kodak Company presently sells Kodak Ektamax RA-4 Proofing Paper. The technology for this product is described in U.S. Ser. No. 810,311 filed on Dec. 19, 1991.

There are also black-and-white negative type film products such as Agfa XP based upon chromogenic coupler technology.

Japanese Kokai Patent Application No. Hei 3[1991]-107144—Inabata and Suzuki disclose the use of coupler mixtures to form a black-and-white image when processed in a color development process without a fixing bath.

There have been commercialized products that have formed black-and-white images by the use of pan sensitized emulsions which contain three spectral sensitizing dyes, color dye forming couplers and one emulsion. These pan-sensitive emulsions are sometimes coated in a fast and a slow layer to form images after exposure and development of the couplers. While the above products are somewhat successful, they do not achieve a neutral image. Additionally, the tone reproduction of such materials is severely limited by the contrast range of the emulsion.

Problem to be Solved by the Invention

There is a need for high quality black-and-white photographic products that are suitable for development in color imaging systems. Further, there is a desire that silver be recovered from the photographic print used to form the black-and-white images rather than being a part of the image and, therefore, not recoverable.

Summary of the Invention

It is an object of the invention to provide black-and-white images that are developable in color processes.

It is an object of the invention to provide black-and-white images of improved tone scale by the use of color couplers and conventional color processing.

The invention is generally accomplished by a photographic element comprising at least one color correcting layer consisting essentially of dye forming coupler and gelatin.

In a preferred embodiment there is formed the photographic element wherein adjacent said color correcting layer is at least one imaging layer comprising at least one silver halide emulsion with grains sensitized ,with one color and balanced cyan, magenta, and yellow dye forming couplers.

In a preferred embodiment there is formed the element wherein adjacent said color correcting layer is at least one imaging layer comprising balanced magenta, cyan, and yellow dye forming couplers and red sensitized silver halide grains, green sensitized silver halide grains, and blue sensitized silver halide grains.

Advantageous Effect of the Invention

The invention has numerous advantages over the prior art. By the formation of an accurate black-and-white reproduction of a color exposure, the photographic products of the invention eliminate the need for a separate processing system in order to form black-and-white photographs. The black-and-white photographic system of the invention further allows the recovery of substantially all of the silver from a black-and-white photographic image. Another advantage of the system is that the reproduction of lightness ratios and tone is more accurate than any other system using color couplers to form black-and-white images. Another advantage is that if the lightness and tone of the black-and-white image are desired to be changed, this can be accomplished by the use of conventional color filters during printing of the negative. A photographic print formed in accordance with the invention will respond to changes in filtration of colored light during printing in a manner that allows ready adjustment of tone and lightness. This advantage is not available in other black-and-white photographic systems where pan or ortho sensitive emulsion systems are employed.

DETAILED DESCRIPTION OF THE INVENTION

Figure 1:
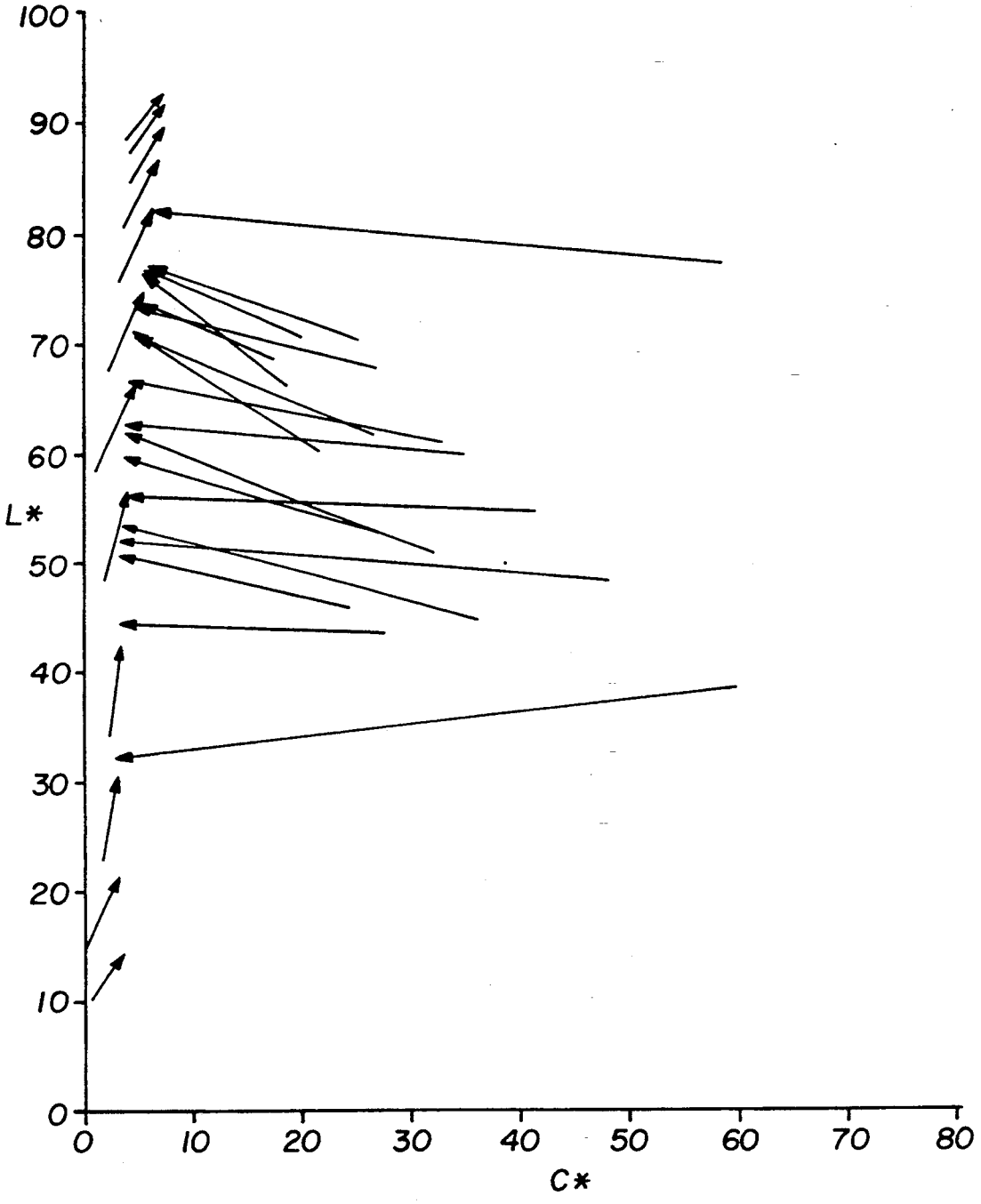
FIG. 1 shows the lightness reproduction vs. chroma of 30 different standard colors and neutral densities when Kodak Panalure M TM black and white paper is compared to Kodak Supra TM color paper when printed with the identical negative. In each case, the tail of the arrow represents the lightness and chroma values obtained with the color paper, while the head of the arrow and the length of the arrow illustrates the change in chroma and lightness when the negative is printed onto Kodak Panalure M black and white paper.

The invention is generally accomplished by providing a photographic element for forming neutral images comprising at least one layer of balanced cyan, magenta, and yellow dye-forming couplers with silver halide grains comprising at least one of blue sensitized silver halide grains and green sensitized silver halide grains.

In a preferred embodiment, there is formed a photographic element comprising at least one layer of balanced cyan, magenta, and yellow dye-forming couplers with blue sensitized silver halide grains, and at least one layer of balanced cyan, magenta, and yellow dye-forming couplers with green sensitized silver halide grains.

In another preferred embodiment, there is formed a photographic element comprising at least one layer of balanced cyan, magenta, and yellow dye-forming couplers and blue sensitized silver halide grains, and green sensitized silver halide grains.

There is also provided a method of forming neutral black-and-white images by developing the above elements of the invention.

In a preferred embodiment, the invention is generally accomplished by forming multilayers consisting of mixtures of coupler dispersions and emulsions. In such a multilayer, there are at least two layers such that there is at least one layer in which silver halide emulsion has been sensitized to blue light, one silver halide emulsion layer sensitive to red light, and one silver halide layer emulsion sensitive to green light. Regardless of the color sensitivity of the silver halide, each emulsion containing layer also contains a mixture of cyan, magenta, and yellow dye-forming couplers.

Further, in order to have a black-and-white image that reproduces the lightness ratios in a scene such as observed by the human eye, it is preferred that the contrast ratios of red sensitive emulsion to green sensitive emulsion to blue sensitive emulsion in the photographic element be about 2:3:1. These contrast ratios have been found to be similar to the relative response of the eye to color lightness changes. This contrast ratio can, however, be changed to meet customer preferences, as well as to increase the range of contrasts that can be effected when black and white or color negatives varying in contrast are to be printed. In like manner, the overall contrast and tone reproduction can be customized by adjusting the silver halide and color coupler coverages such as is typically done with present color and black and white photographic film and paper systems.

While the above systems produce good black-and-white images, there is a need to reduce the amount of material necessary to form the neutral dye image. Specifically, there is a desire to reduce the amount of chromogenic dye forming dispersion in the element without degrading the tone, color or quality of the image. The reason for this is economic. Reducing the amount of material coated without compromising image quality offers substantial coat savings advantages.

To perform this task, it was realized that an unusually large amount of chromogenic dispersion must be coated relative to the amount of silver halide required to convert the couplers to image dye. The reason for this excess material is to insure that a neutral image is maintained throughout the entire exposure scale of $D_{min}$ to $D_{max}$. We have observed that reducing the amount of chromogenic dispersion from the amount referred to as the standard amount to an amount required to achieve the required $D_{max}$ of the print results in a shift in hue of the image. This hue shift changes the desired neutral appearing hue of the image to a colored hue such as greenish.

Since coating large excesses of chromogenic dispersion is cost ineffective, there has been sought means to reduce the amount of coated material. In the invention it has been found that a balanced hue throughout the desired tonal range can be achieved by the application of color correcting layers adjacent to the imaging layer. These color correcting layer(s) may contain one or more silver halide emulsions. It has been shown that the color correcting layer does not require an emulsion, but does need to be adjacent to the imaging layer for maximum efficiency. The color correcting layer contains one or more dye forming couplers whose color complements the unbalanced hue of the adjacent imaging layer.

This invention relates to a photographic element that uses a mixture of dye-forming couplers combined in such a way that when allowed to react with oxidized color developer, a black-and-white image is formed. The image can be viewed either by reflected light, as in a standard black-and-white printing applications or by transmitted light such as slide film, X-ray film, movie print film (or movie intermediate films), or certain other films design for direct viewing.

To make a black and white image using a mixture of dyes formed from couplers, it is necessary to balance the ratio of the couplers in the imaging layer so that after exposure and color development, the resultant image is neutral and lacks any specific color bias. There may, however, be photographic market requirements whereby the color of the desired reproduction may not be neutral. For example, to accurately reproduce the tone of a 'sepia-toned' print, it would be necessary to alter the ratios of the couplers in the dispersion or the ratios of the dispersions in the emulsion layer in such a way that the preferred "sepia-toned" color balance is obtained. This process can be easily done using simple mathematical models. Also, many 'black and white papers' based upon silver halide systems which are presently in the market place are known not to produce a neutral image. Depending upon the formulation of the silver halide material and the nature of the black and white development process, a wide variety of shades of green, red, yellow or brown can be produced. Each having its own unique characteristic color and photographic application.

The phrase "balanced cyan, magenta, and yellow dye-forming couplers" means that the couplers are balanced to provide a generally neutral image. This neutral balanced image would preferably for most uses be black and white. It is also possible in accordance with the invention technique to balance to give a sepia tone or slightly bluish tone to the image but still have a generally neutral image.

The invention utilizes an oil-in-water dispersion containing a mixture of cyan, magenta, and yellow dye-forming couplers. It should also be obvious that separate dispersions containing cyan, magenta and yellow dye forming couplers could be used. In addition, other dispersion addenda such as coupler solvent, auxiliary coupler solvent and/or dye stabilizers can be added. Dispersion addenda such as latex polymers or hydrophobic polymers may also be added. The aqueous phase of the dispersion is composed of gelatin, a surfactant, and water. The composition of the oil phase portion of the dispersion is adjusted so that when processed in a color developing bath, a neutral image is formed whose density varies only in proportion to the amount of silver developed in the process. In the instance where separate coupler dispersions are used, the appropriate ratios of each dispersion are added to the layer so that after exposure and development a neutral image is formed.

Once prepared, the coupler dispersion may in one embodiment be coated in a multilayer format much like that used in conventional color film or paper. There are two major differences, however; the first difference is that the same neutral dye-forming coupler dispersion is coated in each emulsion containing layer. Thus, regardless of whether the element is exposed to red, green, or blue light, a neutral image is formed during color development in proportion to the amount of silver development. After color development, the developed and undeveloped silver are removed from the element by bleaching and fixing, or more simply, blixing (bleach-fixing).

The second difference is that the ratios of sensitized silver halide in the element are adjusted so that the lightness of the object being reproduced in the original scene is more accurately reproduced. This effect is obtained by coating the spectrally sensitized silver halide layers in amounts which correspond to the eye's relative sensitivity to light. It is generally agreed that the eye's response the red, green and blue light is in the ratio of about 2:3:1. Higher numbers indicate greater sensitivity. Therefore, in the invention element, the ratios of the amount of red sensitive emulsion to the amount of green sensitive emulsion to the amount of blue sensitive emulsion is also preferred to be about 2:3:1. However, this ratio can be adjusted to any ratio depending upon the needs and requirements of the photographic system. For example, films designed for X-ray applications which are currently coated on a blue support might choose to enhance the visual process of contrast discrimination by using ratios of 2:2:1 or 3:2:1.

In the second embodiment of the invention, the oil in water dispersion containing a mixture of cyan, magenta, and yellow dye-forming couplers is coated in a layer that contains silver halide grains sensitized to more than one color. In this embodiment the silver halide grains are a mixture of grains sensitized to be sensitive to different light colors. Preferably, the silver halide emulsion contains blue sensitized, green sensitized, and red sensitized silver halide grains. An element may only contain the blue sensitized and green sensitized silver halide grains to form an ortho sensitized element.

The invention may be performed with the materials conventionally utilized in color papers. As known, such papers comprise couplers for forming yellow, cyan, and magenta dyes. It is most common to use predominantly silver chloride emulsions with color paper, as they are suitable for fast processing. It should be apparent that other photographic systems may require the use of emulsions other than silver chloride. Such systems may in fact require silver chlorobromide, silver bromide, silver bromoiodide or silver chlorobromoiodide. The emulsions are sensitized to light in the wavelength to be absorbed by the particular layer where they are present. For instance, silver halide grains in the yellow layer will be most sensitive to blue light, and silver halide grains in the magenta layer will be most sensitive to green light. The use of sensitizing dyes to provide such emulsions is well known. Reference is made to *Research Disclosure* #308119, published December, 1989 for a description of emulsion formation, sensitizing dyes, antifoggant and stabilizers, couplers, hardeners, coating aids, and other conventional materials for use in silver halide image formation. The invention is considered to be able to be practiced with any of the known materials for use in color silver halide photography. Further, it is anticipated that the technique will be satisfactory for use with future materials using silver halide and dye-forming couplers that form yellow, cyan, and magenta dyes.

The following is a listing of preferred cyan, magenta, and yellow couplers for the invention. Following the couplers are the structures of three preferred hydroquinones for the invention.

Cyan Couplers

A2

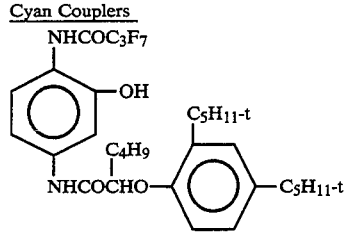

A3

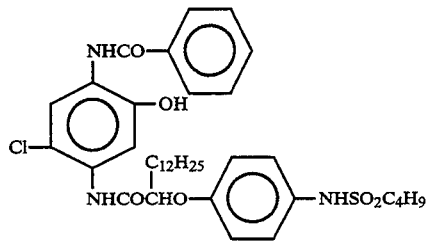

A4

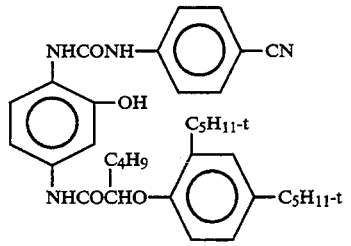

A5

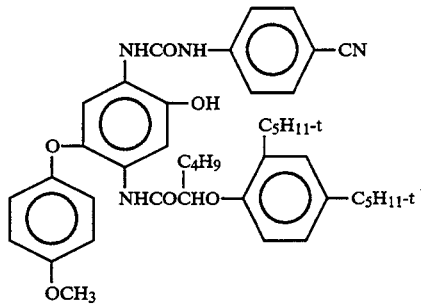

-continued
A6
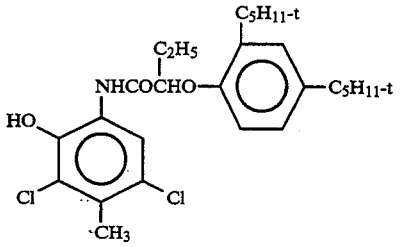
A7
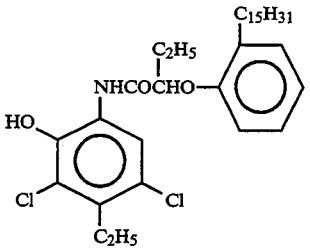
A8
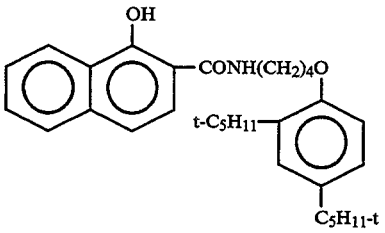
A9
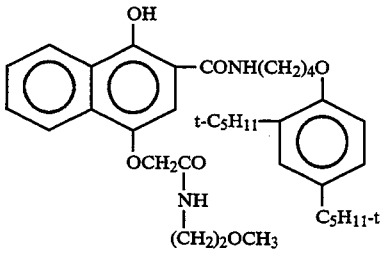
A10
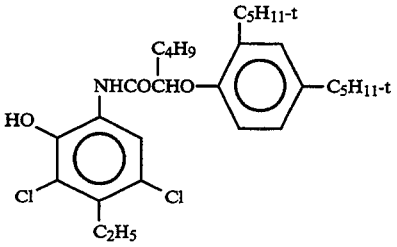
A11
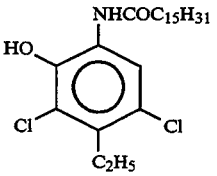
-continued
A12
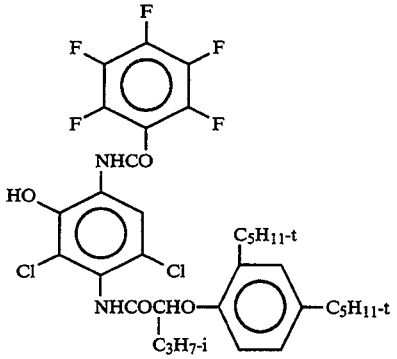
Magenta Couplers
B2
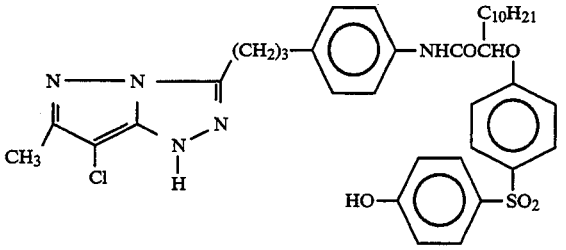
B3
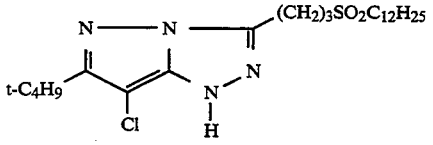
B4
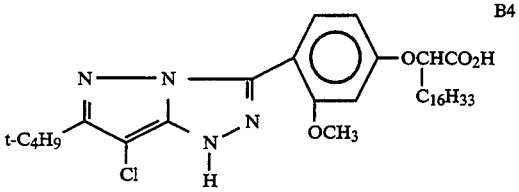
B5
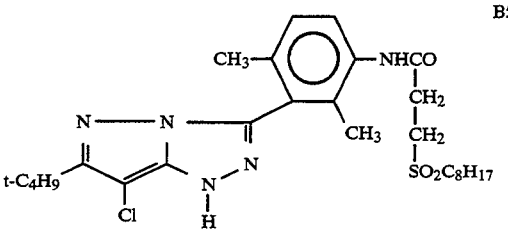
B6
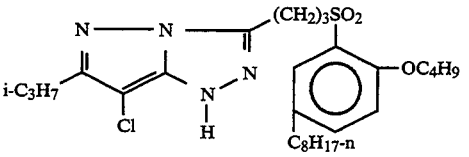

-continued
B7
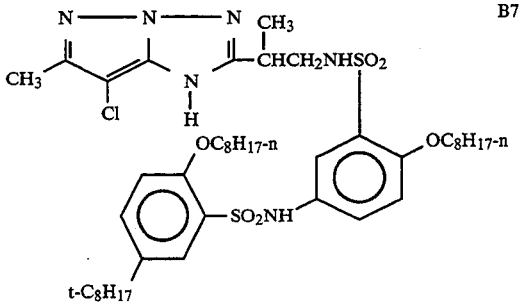
B8
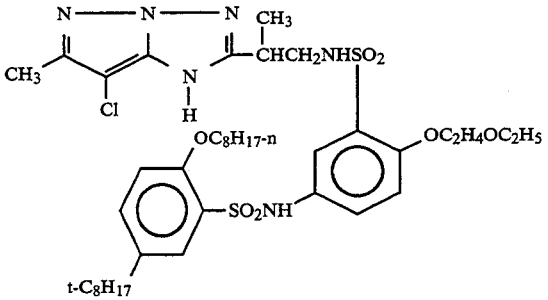
B9
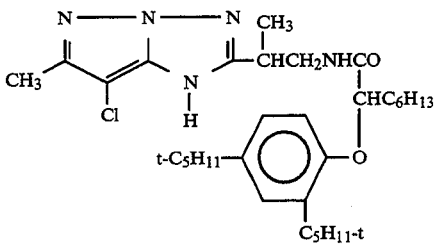
B10
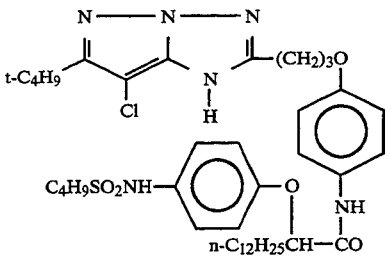
B11
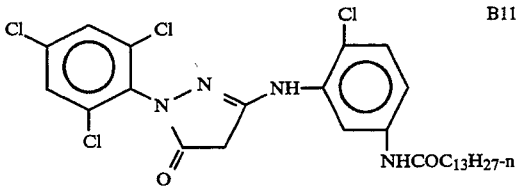
B12
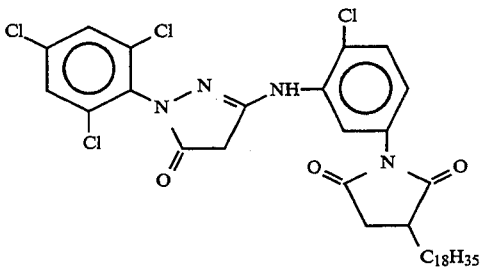
-continued
B13
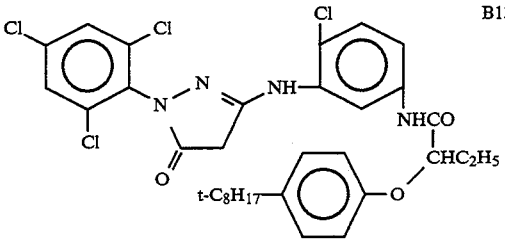
B14
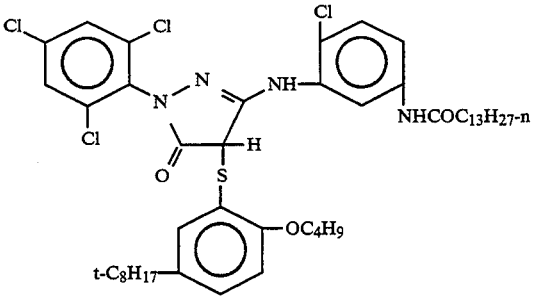
B15
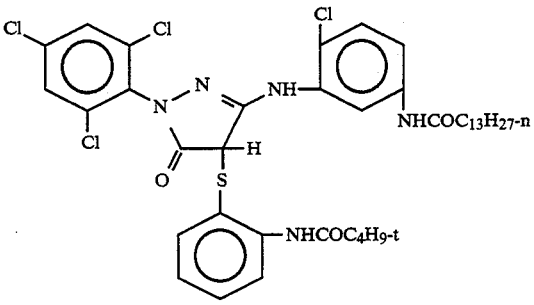
B16
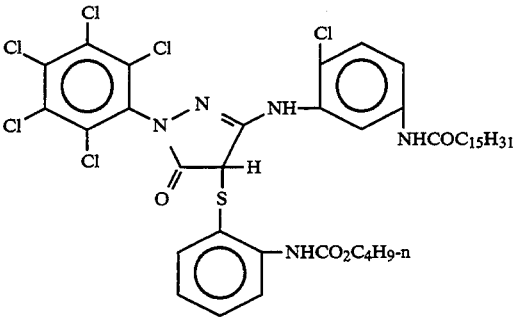
B17
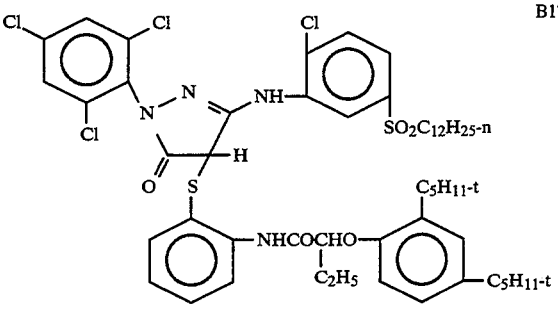

-continued
B18
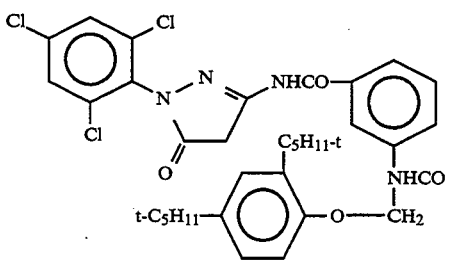
B19
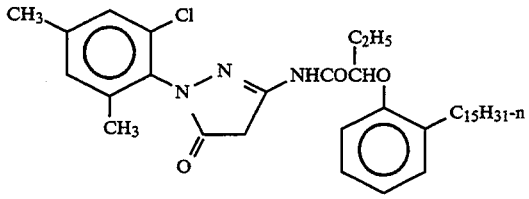
Yellow Couplers
C2
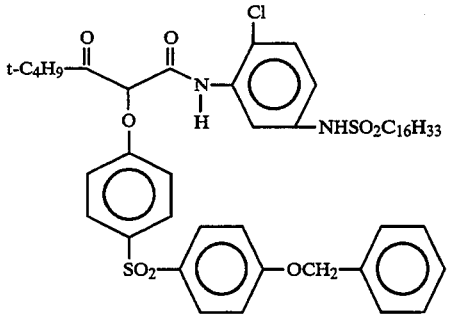
C3
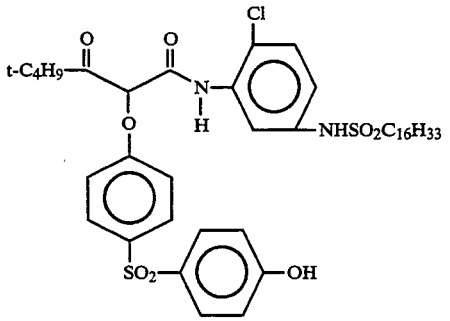
C4
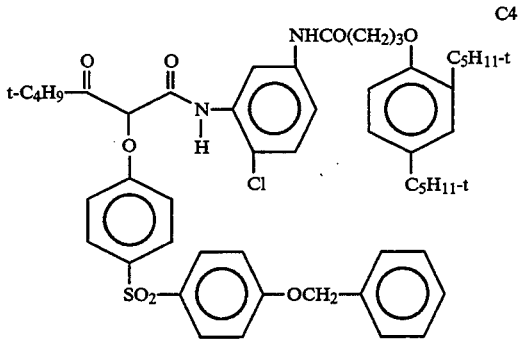
-continued
C5
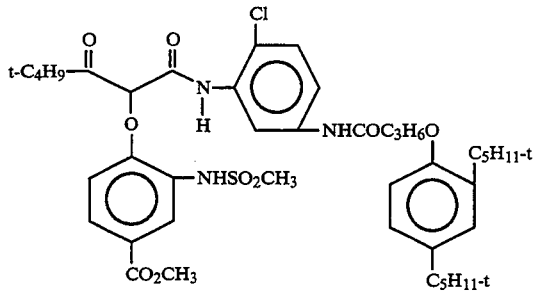
C6
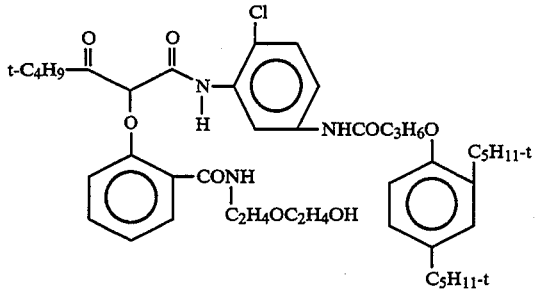
C7
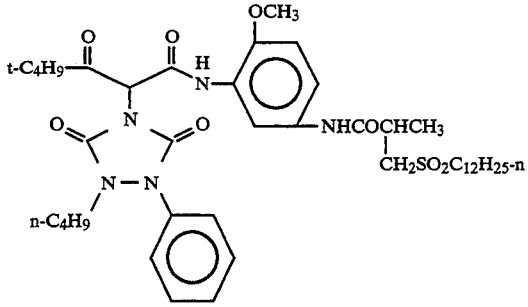
C8
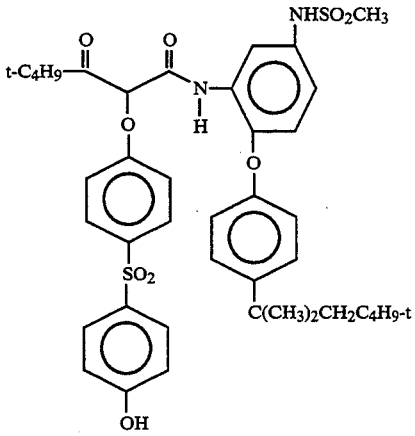
C9
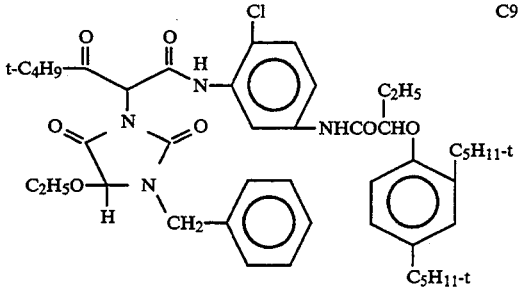

-continued

C10

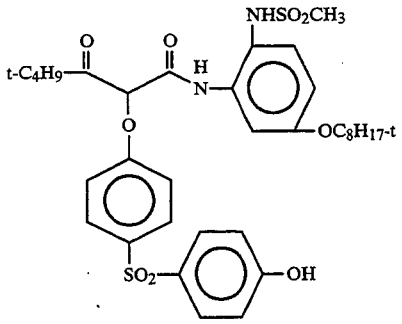

C11

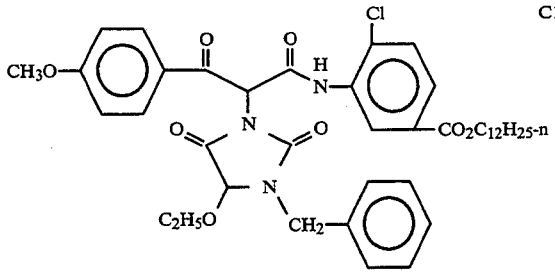

C12

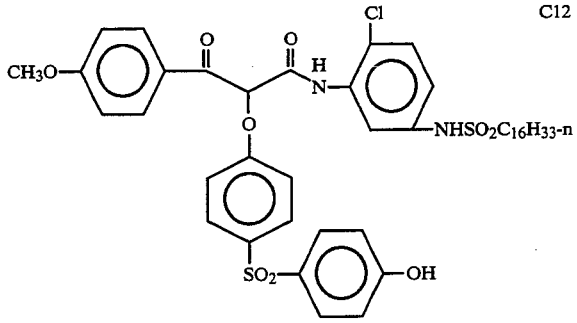

Hydroquinones

H

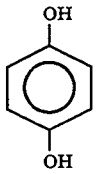

H2

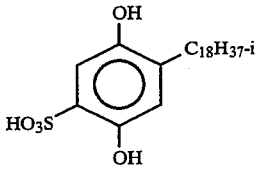

H3

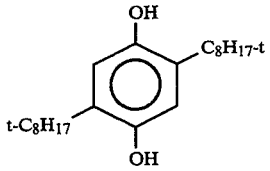

H4

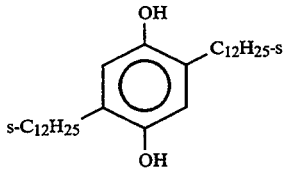

-continued

H5

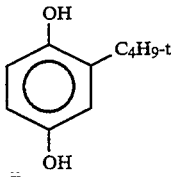

H6

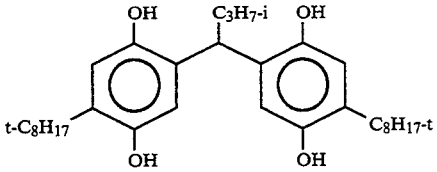

H7

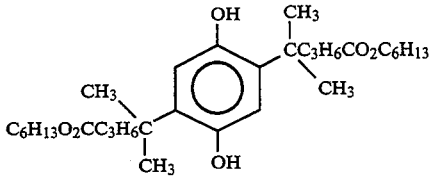

The examples below are intended to be illustrative and not exhaustive of the invention:

PRACTICE OF THE INVENTION

The following example is used to illustrate the practice of this invention:

Example: 1 Formulation of a Neutral Image Forming Dispersion

The oil phase of the dispersion formula is composed of a mixture of:

| | |
|---|---|
| Cyan coupler A | 50.0 grams |
| Magenta coupler B | 37.1 grams |
| Yellow coupler C | 65.6 grams |
| Coupler solvent D | 62.6 grams |
| Auxiliary solvent E | 78.5 grams |

The aqueous phase of the dispersion is composed of a mixture of:

| | |
|---|---|
| Gelatin | 120.0 grams |
| Alkanol-XC Surfactant | 12.0 grams |
| Water | 1574.2 grams |
| Total | 2000.0 grams |

Procedure:

1) The materials used in the oil phase are combined and heated to 125° C. with stirring until dissolution occurs.

2) After dissolution occurs, the hot oil phase is quickly added to the preheated (70° C.) aqueous phase mixture with stirring.

3) The mixture is then passed through a colloid mill, collected, then rapidly chilled until the dispersion is set.

The above preferred formula was derived from a statistically designed central composit mixture experiment in which the ratio of the components of the oil phase were systematically varied in different proportions. In all, 27 different formulations, including replicates of the center point were made and tested. Once the coupler dispersions were prepared, they were mixed with additional gelatin, water, and silver halide and coated on a resin coated paper support in a single layer format. The following sample format describes the structure:

| Coating 1 | |
|---|---|
| Overcoat | 1076. mg gel/$m^2$ |
| | spreading aids |
| | gel hardener |
| Emulsion | 710. mg/m2 red sensitive silver chloride |
| | 1615. mg gel/$m^2$ |
| | 377. mg cyan coupler/$m^2$ |
| | 280. mg magenta coupler/$m^2$ |
| | 495. mg yellow coupler/$m^2$ |
| (Coupler coverages based upon dispersion formulation above.) | |
| Gel sub | 3229. mg gel/$m^2$ |
| Support | resin coated paper |

Once coated, the samples were given a step exposure on a KODAK Model 1B sensitometer. Specifically, they were exposed for 0.1 seconds to a 3000° K tungsten light source through a 0–3 density step wedge. After exposure, the samples were processed through a standard Process RA-4 color process. The process consists of a 45-second developer, a 45-second bleach-fix, and a 90-second wash. The coated paper samples were subsequently dried with hot air.

| The RA-4 Color Developer consists of: | |
|---|---|
| Triethanol amine | 12.41 g/l |
| Phorwite REU | 2.30 |
| Lithium polystyrene sulfonate (30%) | 0.30 |
| N,N-diethylhydroxylamine (85%) | 5.40 |
| Lithium sulfate | 2.70 |
| Kodak color developer CD-3 | 5.00 |
| DEQUEST 2010 (60%) | 1.16 |
| Potassium carbonate | 21.16 |
| Potassium bicarbonate | 2.79 |
| Potassium chloride | 1.60 |
| Potassium bromide | 7.00 mg/l@ |
| Water | to make 1 liter@ |
| pH @ 80F is 10.04 +/− 0.05 | |
| The RA-4 Bleach-fix consists of: | |
| Ammonium thiosulfate (56.5%) | 127.40 g/l |
| Sodium metabisulfite | 10.00 |
| Glacial acetic acid | 10.20 |
| Ammonium ferric EDTA (44%) | 110.40 |
| Water | to make 1 liter@ |
| pH @ 80F is 5.5 +/− 0.10 | |

Processing the exposed paper samples is done with the developer and bleach-fix temperatures adjusted to 95° F. Washing is performed with tap water at 90° F.

Testing for Neutrality:

After the developed samples are dried, the densities of each step are measured to determine which exposure step produced a status A density nearest 1.0. Once determined, that exposure step has its visible absorption spectra measured. The spectrophotometric data is then converted to colorimetric data, and the corresponding a*, b*, C* and L* values are calculated.

These color coordinates are well-known metrics in the CIE System (International Commission on Illumination), and their derivation is discussed at length in many texts on color science. One such example is PRINCIPLES OF COLOR TECHNOLOGY, 2nd Edition, authored by Fred W. Billmeyer, Jr. and Max Saltzman, which is published by John Wiley and Sons, New York with pages 25–66 being of particular interest.

Accordingly, the metrics, a* and b* are measures of the color of an object. The value of a* are generally thought of as a measure of the amount of redness or greenness of an object. An object with a positive value for a* is increasingly red while a negative value for a* indicates the degree of greenness in the object. Likewise for b*, a positive value indicates more yellowness; while negative b* values indicate increasing blueness.

An objects lightness or darkness is measured using the term L*. An L* value of 100 indicates that the object is perfectly white; while an L* value of 0 indicates that the object is perfectly black. Values of L* between 0 and 100 indicate intermediate lightness. Chroma, or color saturation, is calculated as C* using the equation described below. In black and white imaging systems it has little meaning since it is derived from the a* and b* terms which are both near zero indicating no color. In black and white photographs, C* is also near zero. For an object to be rendered neutral, it should have a very small values for a* and b*. In fact, the closer that a* and b* are to zero, the lesser amount of color in the object and the more neutral appearing the object will be rendered. In the examples below, L* describes the lightness of the sample patch and does not relate to the color of the patch.

In our colorimetric calculations, we assume a color temperature of D5500 and have used the 1931 CIE 2 degree standard observer.

In the coated example described above, the colorimetry results for the test patch produced an a* value of −1.15 and a b* of 1.23 with a lightness L* of 38.2. Both the a* and b* values are close to zero indicating neutrality was achieved. As added confirmation, the sample patch when viewed under the appropriate D5500 illumination appeared visually neutral with no evidence of a color bias.

The calculation of the colorimetric values for a*, b*, L* and C* is straightforward and is discussed in detail in the reference noted above. However, to further clarify their calculation, the following derivations are given for the four terms.

First it is necessary to know the spectral power distribution of the light source used as the viewing illuminant. For these calculations we have chosen a daylight source with a color temperature of 5500° Kelvin (D5500). The spectral power distribution, P(lambda), of this source is well known and we have chosen to use the spectral range of 340 nm to 800 nm in 10 nm increments. Secondly, it is necessary to know the reflectance spectrum, R(lambda), of the object being observed. These data are conveniently obtained by using any commercial reflectance spectrophotometer. The wavelength range measured is 340 nm to 800 nm. Lastly, it is necessary to know the 1931 CIE 2° standard observer functions x(lambda), y(lambda) and z(lambda). These values are also conveniently obtained over the necessary wavelength range from the reference text cited above.

Once the above values are obtained, they are multiplied together as a function of wavelength and the individual values for x(lambda), y(lambda) and z(lambda) are summed to obtain the tristimulus values X, Y and Z. Once obtained, the tristimulus values are used to calculate the colorimetric values of a*, b*, L* and C* using the equations given below:

$$a^*=500[(X/X_n)^{\frac{1}{3}}-(Y/Y_n)^{\frac{1}{3}}]$$

$$b^*=200[(Y/Y_n)^{\frac{1}{3}}-(Z/Z_n)^{\frac{1}{3}}]$$

$$L^*=116(Y/Y_n)^{\frac{1}{3}}-16$$

$$C^*=(a^{*2}+b^{*2})^{\frac{1}{2}}$$

In these equations, $X_n$, $Y_n$ and $Z_n$ represent the tristimulus values for the reference white.

Other metrics are also useful when evaluating the tone scale reproduction of various photographic systems. For example, when comparing the color reproduction of an object when reproduced by two different color photographic systems, it is often convenient to describe the tonal difference as delt-E*, which is defined as:

$$delt\text{-}E^* = [(delt\text{-}L^*)^2 + (delt\text{-}a^*)^2 + (delt\text{-}b^*)^2]^{\frac{1}{2}}$$

This equation is known as the color difference equation and was defined by the CIE in 1976. Examination of the equation shows that color difference can be determined by calculating the square root of the sums of the squares of the differences of L*, a* and b* of the two objects.

To further the analogy, it is often desirable to assess the overall tone reproduction of a black and white print which was used to reproduce a scene containing various and assorted colors and compare its tone reproduction to that of a color photograph of the same original scene. One method of comparing two photographic reproductions for tonal accuracy is to use the color difference equation described above.

To assess the difference, it is first necessary to photograph the scene. In our case, a test scene is prepared which contains a neutral step wedge exposure and assorted other colors which include red, green, blue, cyan, magenta, yellow and other color shades. The color negative used to photograph the scene is developed and subsequently used to print the scene onto the black and white papers being compared. Two commercially available black and white printing papers are Kodak Polycontrast III paper and Kodak Panalure M paper. The Polycontrast III paper is an ortho sensitive paper. This means that it is spectrally sensitive in the blue and green regions of the visible spectrum. In contrast, the Kodak Panalure M paper is pan sensitive. This means that it has sensitivity to red, green and blue light. The third black and white paper to be tested is the paper described below in the multilayer invention.

To make the comparison, the papers described above and a Kodak Ektacolor Supra TM color paper are printed onto with the color negative containing the test scene. The color print is developed in the standard Kodak RA-4 Color Development Process. The Kodak Polycontrast III and the Kodak Panalure M prints are developed in their respective recommended black and white processes. The chromogenic black and white paper of the invention is developed in the same Kodak RA-4 Color Development Process as is the color print above. After printing each paper and matching the density of one of the neutral patches (at approximately 0.8 density), each color and neutral patch of each print has its visible absorbtion spectra determined. These absorption spectra are then converted to their corresponding tristiumlus values and, hence, their colorimetric values are described using the equations above.

To assess the overall colorimetric reproduction error, a comparison can be made between the Kodak Ektacolor Supra Color Paper print relative to the Kodak Polycontrast III print, the Kodak Panalure M print and the chromogenic black and white print from the invention described below. To assess the overall error in tonal reproduction it is convenient to sum the delt-E*'s for each of the 30 patches of each print. Clearly, the print which has the lowest delt-E* sum has the smallest error in tonal reproduction relative to the color print. The following table shows the accumulated delt-E*'s for the black and white prints described above:

TABLE 1

| Print Material | delt-E* |
|---|---|
| Kodak Polycontrast III | 755.7 |
| Kodak Panalure M | 688.3 |
| Invention | 633.7 |

The values for delt-E* listed in Table 1 include in their calculation, the relative changes in a* and b* for each test patch. Since it is expected that a* and b* will approach zero in a black and white print the values for delt-E* will be expectedly large. To better clarify the tonal issue of these reproductions, it is simplier to compare the absolute differences in lightness of each patch by comparing and defining a new colorimetric term delt-Z* which is simply the absolute value of the differences in lightness between two test patches:

$$delt\text{-}Z^* = |L^*_1 - L^*_2|$$

If we then sum the delt-Z* values for each of the test patches for each of the prints using the Kodak Ektacolor Supra Color Print as the reference print, we can see then in Table 2, below, that the invention retains the lower overall error in lightness reproduction when compared to either of the other black and white print materials.

TABLE 2

| Print Material | delt-E* |
|---|---|
| Kodak Polycontrast III | 312.6 |
| Kodak Panalure M | 182.0 |
| Invention | 107,8 |

Figure 2:
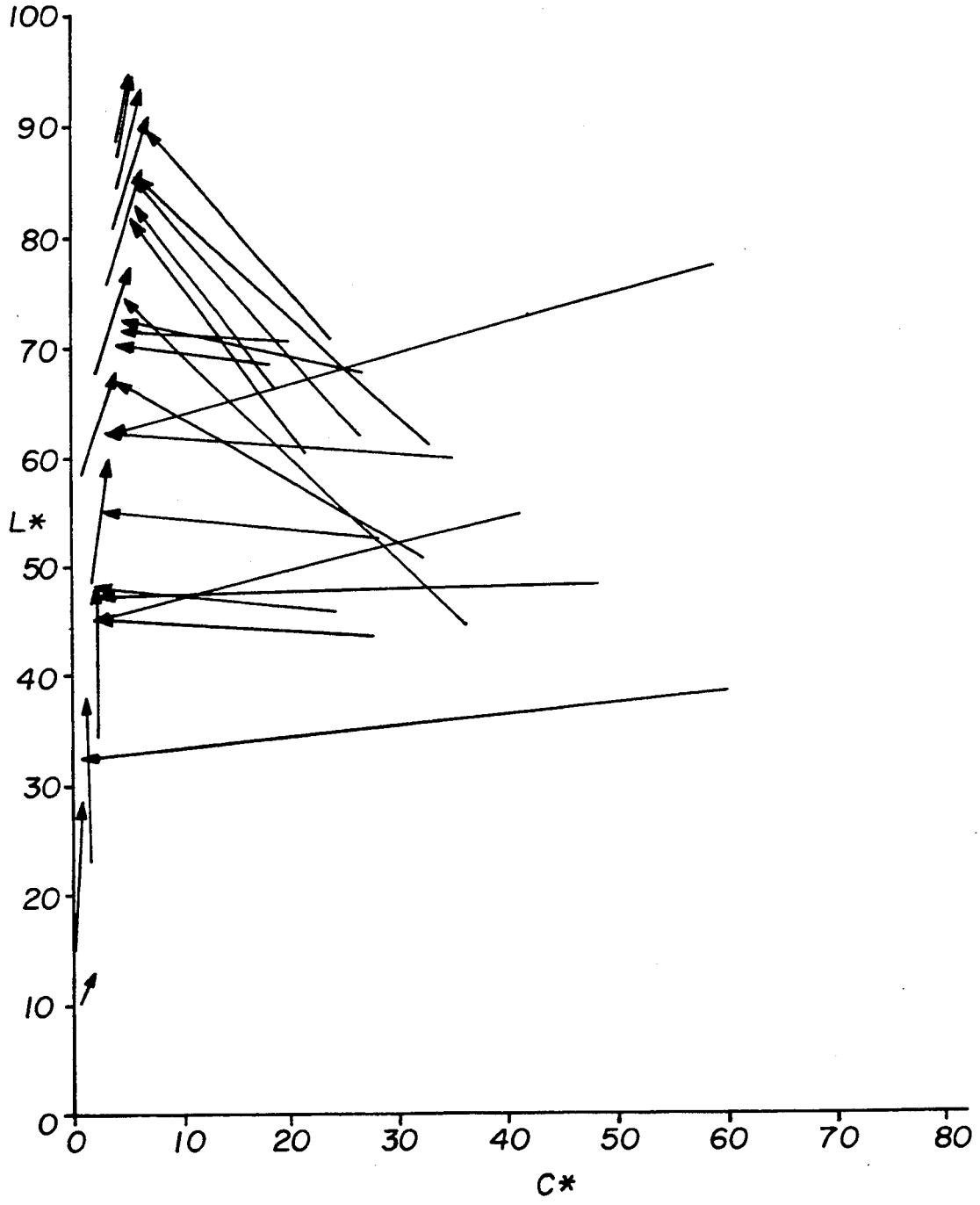
FIG. 2 illustrates the comparison when Kodak Polycontrast III TM black and white paper is used in place of the Kodak Panalure M paper.
Figure 3:
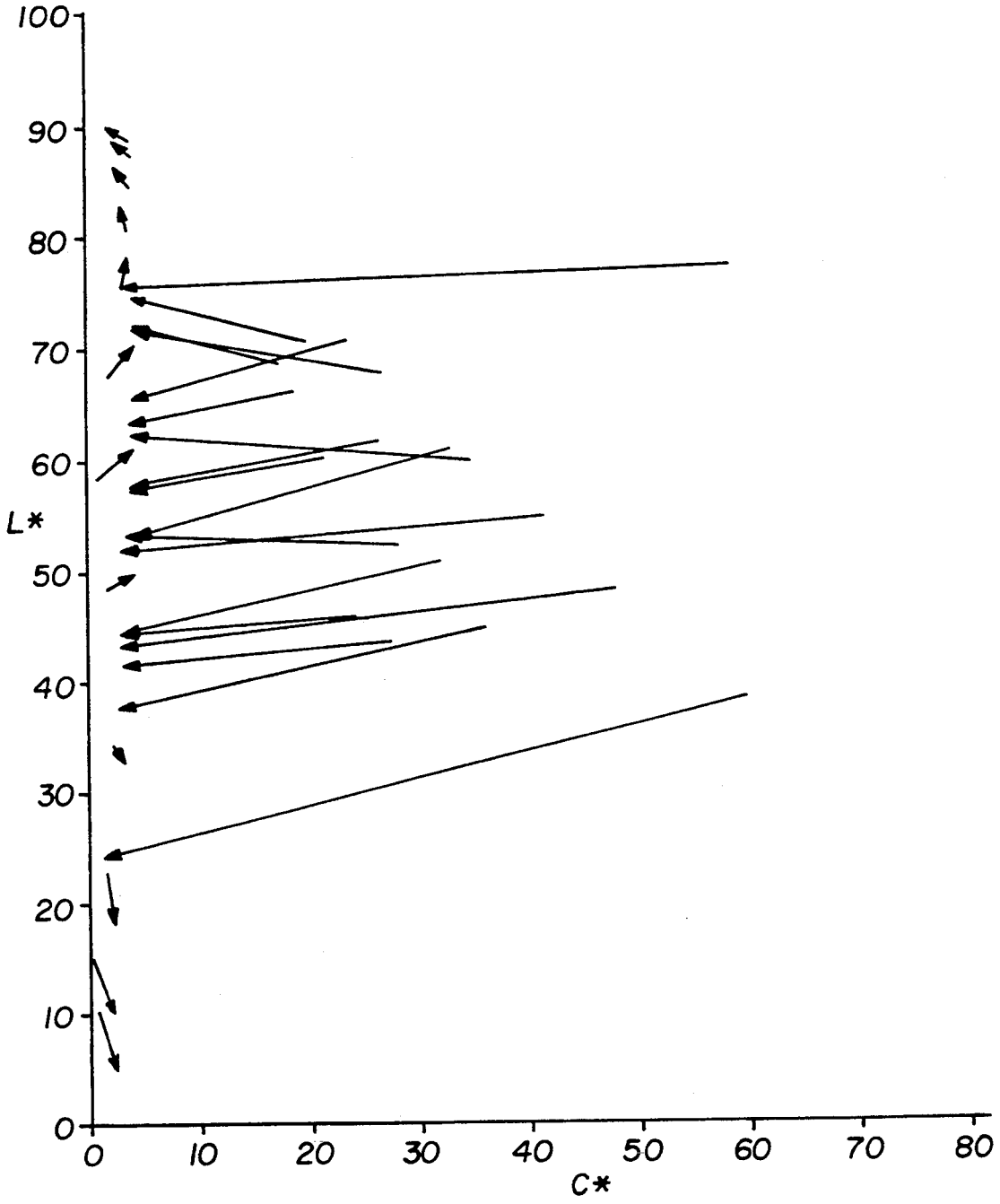
FIG. 3 illustrates the changes in lightness obtained when a black and white printing paper such as that described in this invention is used in place of the Kodak Panalure M paper.

Graphical information for these data are presented in FIGS. 1, 2 and 3. These graphs show the relative changes in chroma C* and lightness L* for each of the 30 different test patches in each test print when comparing the tonal reproduction of the Kodak Polycontrast III, Kodak Panalure M and the invention when compared to Kodak Ektacolor Supra Color Paper.

Formulation of a multilayer example in color paper format:

| Layer | Composition | mg/m$^2$ |
|---|---|---|
| Overcoat | Gelatin | 1346. |
| UV absorbing layer | Tinuvin 326 | 64.6 |
| | Tinuvin 328 | 366. |
| | Oxidized developer scavenger (F) | 64.6 |
| | Gelatin | 656. |
| Red sensitive layer | Red sensitive silver | 322. |
| | Cyan coupler (A) | 280. |
| | Magenta coupler (B) | 208. |
| | Yellow coupler (C) (From the neutral dye forming dispersion) | 368. |
| | Gelatin | 1184. |
| UV absorbing layer | Tinuvin 326 | 64.6 |
| | Tinuvin 328 | 366. |
| | Oxidized developer scavenger (F) | 64.6 |
| | Gelatin | 656. |
| Green sensitive layer | Green sensitive silver | 407. |
| | Cyan coupler (A) | 421. |
| | Magenta coupler (B) | 313. |
| | Yellow coupler (C) (From the neutral dye forming dispersion) | 553. |
| | Gelatin | 1184. |

-continued

| Layer | Composition | mg/m$^2$ |
|---|---|---|
| Interlayer | Oxidized developer scavenger (F) | 93.6 |
| | Gelatin | 753. |
| Blue sensitive layer | Blue sensitive silver | 80.7 |
| | Cyan coupler (A) | 140. |
| | Magenta coupler (B) | 104. |
| | Yellow coupler (C) (From the neutral dye forming dispersion) | 184. |
| | Gelatin | 1507. |
| Standard color paper support (resin coated) | | |

The film structure illustrated above is similar to current conventional color paper. However, it is considered that for the black-and-white paper of the invention, the Interlayer and middle UV absorbing layer would preferably not be present as there is no need to prevent cross contamination of oxidized developer between layers.

All three emulsions used in the multilayer element are silver chloro-bromide (99:1).

This coating was made on a conventional film forming machine. After coating it was exposed and processed as described earlier. The colorimetric data was also obtained as described earlier. The results of the analysis show that at status A densities of 1.03 red, 1.04 green and 1.02 blue, the corresponding a* and b* values are 0.18 and 0.09 respectively. The related L* value is 38.5. In addition to the extremely low a* and b* values, the exposed patches appeared to be visually neutral.

A

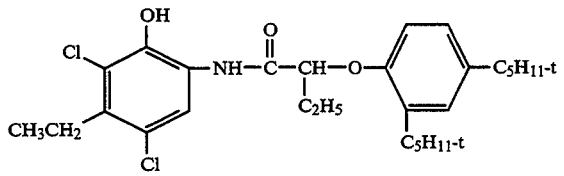

B

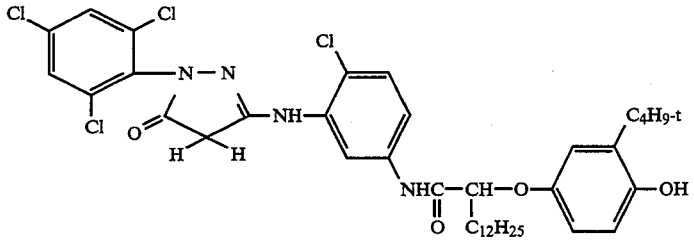

C

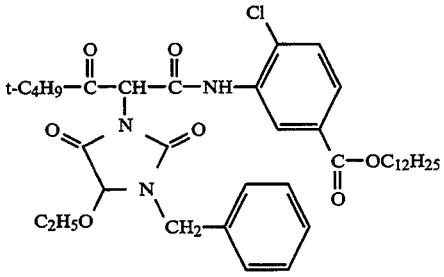

D

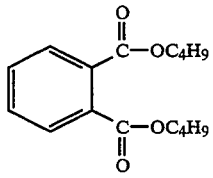

E

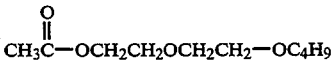

Tinuvin 328

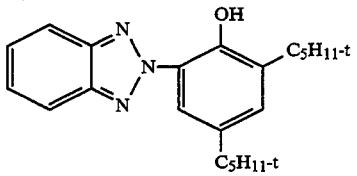

Tinuvin 326

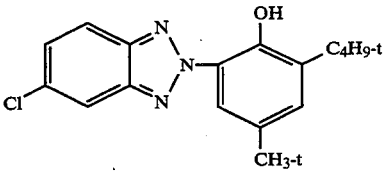

Alkanol-XC

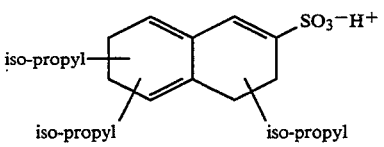

Dequest 2010

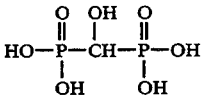

CD3

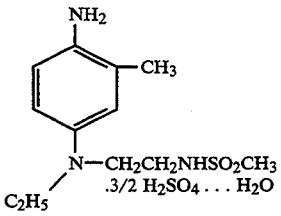

-continued

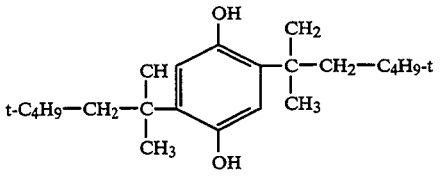

F

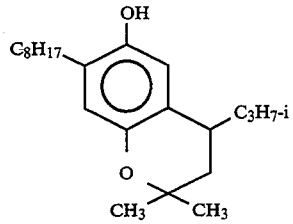

L

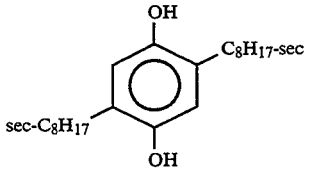

N

| Layer Structure 1: Multilayer Format (Example 1) | | |
|---|---|---|
| Layer | Material | Coverage (mg/M2) |
| Overcoat | gelatin | 1345.0 |
| | N | 21.5 |
| | D | 64.6 |
| | Alkanol-XC | 21.5 |
| UV Absorber | gelatin | 1398.8 |
| | Tinuvin 326 | 113.0 |
| | Tinuvin 328 | 640.2 |
| | N | 75.2 |
| Red Sensitive Layer | gelatin | 1990.6 |
| | Red sensitive silver halide | 351.7 |
| | Cyan coupler (A) | 478.3 |
| | Magenta coupler (B) | 252.2 |
| | Yellow coupler (C) | 562.5 |
| | Stabilizer (L) | 187.0 |
| | Coupler Solvent (D) | 562.0 |
| | Aux. Solvent (E) | 530.9 |
| Green Sensitive Layer | gelatin | 2152.0 |
| | Green sensitive silver halide | 187.7 |
| | Cyan coupler (A) | 340.0 |
| | Magenta coupler (B) | 178.2 |
| | Yellow coupler (C) | 399.8 |
| | Stabilizer (L) | 132.9 |
| | Coupler Solvent (D) | 399.5 |
| | Aux. Solvent (E) | 377.4 |
| Blue Sensitive Layer | gelatin | 1506.4 |
| | Blue sensitive silver halide | 70.4 |
| | Cyan coupler (A) | 175.7 |
| | Magenta coupler (B) | 92.7 |
| | Yellow coupler (C) | 206.6 |
| | Stabilizer (L) | 68.7 |
| | Coupler Solvent (D) | 206.5 |
| | Aux. Solvent (E) | 195.0 |
| Resin Coated Support | | |

| Layer Structure 2: Multilayer Format (Example 2) | | |
|---|---|---|
| Layer | Material | Coverage (mg/M2) |
| Overcoat | gelatin | 1345.0 |
| | N | 21.5 |
| | D | 64.6 |
| | Alkanol-XC | 21.5 |
| UV Absorber | gelatin | 1398.8 |
| | Tinuvin 326 | 113.0 |
| | Tinuvin 328 | 640.2 |
| | N | 75.2 |
| Red, Green, and Blue Sensitive Layer | gelatin | 3509.5 |
| | Red sensitive silver halide (optional) | 351.7 |
| | Green sensitive silver halide | 187.7 |
| | Blue sensitive silver halide | 70.4 |
| | Cyan coupler (A) | 997.6 |

-continued

| Layer Structure 2: Multilayer Format (Example 2) | | |
|---|---|---|
| Layer | Material | Coverage (mg/M2) |
| | Magenta coupler (B) | 526.1 |
| | Yellow coupler (C) | 1173.1 |
| | Stabilizer (L) | 390.0 |
| | Coupler Solvent (D) | 1172.1 |
| | Aux. Solvent (E) | 1107.3 |
| Resin Coated Support | | |

Layer Structure 1 shown above, gives the structure and composition of the photographic element referred to in Example 1. Layer Structure 2 shown above shows the structure of Example 2 in which all three spectrally sensitized emulsions are contained in a single emulsion layer. This element would be referred to as being 'pan-sensitized'. It is formed and processed as in Example 1 to produce a pleasing black and white print.

Examples 3–7: Blended Yellow Emulsions for Improved Exposure Latitude

It was found that in order to accurately reproduce the lightnesses of objects in the element described herein when using color negatives, that the amount of blue sensitive emulsion needed was comparatively smaller relative to the amounts of red or green sensitive emulsion.

However, because the emulsions used in these elements are monodisperse, they produce only a narrow range of exposure latitude when processed. This deficiency is even more exaggerated when the coverage of the emulsion is significantly reduced for reasons such as the lightness reproduction referred to above.

To correct for this deficiency, it is possible to design an emulsion which is more disperse, thus improving the desired exposure latitude. This polydisperse emulsion when used in place of the mondisperse emulsion would increase the relative exposure latitude of the element resulting in black and white prints having more perceivable detail in tones where the polydisperse emulsion was exposed.

An alternative approach to this correct for this deficiency is to blend two or more emulsions of different grain sizes or sensitivities which have similar spectral sensitizations. If one chooses to develop two emulsions of similar sensitizations but different grain sizes, there will be a difference in their sensitivity towards light. The larger grain will be more sensitive and the smaller grain less sensitive. Since these two or more emulsions will inherently have different sensitivities because of their respective grain size differences, the blend of at least two such emulsions will result in an effectively increased exposure latitude.

An example of this technology was achieved by blending two, monodisperse yellow emulsions of different grain sizes. Table 1 given below describes the emulsion grains used to achieve this improvement in exposure latitude. The choice of the relative sizes of the emulsions is based upon known metrics for estimating relative sensitivity differences between emulsion grain sizes where the grain shapes are similar.

In the example shown below, the calculated sensitivity difference between the first and second grain is 0.23 log exposure. This difference in sensitivity was judged to be sufficient to increase the relative exposure latitude of the element without being so great as to not be exposed due to insufficient sensitivity or so large as to not be significantly different from the first emulsion in sensitivity.

TABLE 1

| Example No. | First Emulsion Cubic Edge Length | Second Emulsion Cubic Edge Length | Ratio of Emulsions |
|---|---|---|---|
| 3 | 0.60μ | 0.46μ | 1.00:0.00 |
| 4 | 0.60μ | 0.46μ | 0.75:0.25 |
| 5 | 0.60μ | 0.46μ | 0.50:0.50 |
| 6 | 0.60μ | 0.46μ | 0.25:0.75 |
| 7 | 0.60μ | 0.46μ | 0.00:1.00 |

The elements described above were prepared according to the description and formulas shown in the multilayer element described in Example 1, Layer Structure 1. The blended emulsions described above as Examples 3–7 were substituted for the single blue sensitive emulsion. The blended pair of emulsions were coated at the same coverage as the single emulsion. The materials prepared were exposed with a color negative which prior had been exposed to a variety of colored test objects of various lightnesses. The examples were then processed through the standard Kodak Ektacolor RA-4 process. The resulting prints were then judged for improved exposure latitude by experienced observers.

The results of the judging indicate that the print showing the greatest improvement in exposure latitude is when the blend ratio of the first and second emulsions is 0.50 to 0.50 as in example print number 3. The prints exhibiting the least amount of exposure latitude were Examples 3 and 7. These observations are totally consistent with the premise that the exposure latitude of a sensitized layer can be increased by combining emulsions of different sensitivity. This advantage of mixed emulsions is also considered to result if the single layer structure of Example 2 is used with blended emulsions.

Examples 8–10: Use of Alternate Yellow Dye Forming Couplers for Improved Light Stability An observed deficiency in the performance of the element described in Example 1 is the imbalance in the relative fade rates of the three image dyes towards light. If the rate of fade of the three dyes are not the same, the print will develop an undesirable coloration after prolonged exposure to light. In the first example, previously described, prolonged exposure of the print to light results in a change from a neutral appearing image towards a 'bluish' image. The change in image hue is caused by a loss of yellow image dye at a rate greater the loss of cyan or magenta image dyes.

We have found that some yellow dye forming couplers are less susceptible towards light fade than others. The data presented below in Table 2 shows the comparison fades of coupler C with couplers C5 and C8, two alternate yellow dye forming couplers. These two couplers were dispersed in an oil phase containing a cyan coupler A and a magenta coupler B along with coupler solvent (D) and an auxiliary solvent (E) at a level equimolar to coupler C.

TABLE 2

Change in Red, Green and Blue Density From Initial Density 1.0 After 2 Weeks' Exposure to 50 klux Daylight

| Example | Yellow Coupler | Delta Red | Delta Green | Delta Blue |
|---|---|---|---|---|
| 8 | (C) | −0.10 | −0.09 | −0.22 |
| 9 | (C5) | −0.15 | −0.11 | −0.16 |
| 10 | (C8) | −0.09 | −0.06 | −0.10 |

Examples 11–15

Using a modified dispersion formulation in which the stabilizer, (L), was omitted from the oil phase, other yellow couplers were compared to (C) to determine their light stability. The results of these experiment are given below in Table 3.

TABLE 3

Change in Blue Density from Initial Density 1.0 After 2 Weeks' Exposure to 50 klux Daylight

| Example | Yellow Coupler | Delta Blue |
|---|---|---|
| 11 | (C) | −0.50 |
| 12 | (C2) | −0.38 |
| 13 | (C5) | −0.33 |
| 14 | (C3) | −0.36 |
| 15 | (C6) | −0.38 |

These dispersions were prepared by replacing the (C) coupler in the chromogenic dispersion with an equimolar amount of each of the other yellow couplers. The dispersion formula used and method of preparation is given in Example 1.

The data in Tables 2 and 3 clearly show that the light stability of the yellow component in the chromogenic dispersion is significantly improved by replacing the (C) coupler with any of these preferred couplers.

Layer Structure 3 below describes the coating format in which each of these Examples 11–15 was prepared.

Layer Structure 3
Single Layer Coating Structure

| Layer | Description | Coverage (mg/M2) |
|---|---|---|
| Overcoat | Gelatin | 1076 |
| UV Absorber | Gelatin | 1334 |
| | Tinuvin 326 | 129 |
| | Tinuvin 328 | 732 |
| Emulsion/Dispersion | Gelatin | 1614 |
| | Red Sensitive Silver Halide | 699 |
| | Cyan Coupler (A) | 323 |
| | Magenta Coupler (B) | 172 |
| | Yellow Coupler (varies) | 380 |
| | Coupler Solvent (D) | 380 |
| | Aux. Coupler Solvent (E) | 358 |
| Underlayer | Gelatin | 3228 |
| Resin Coated Paper Support | | |

Example 16: Use of Polyester Supports for Diverse Applications

Coating upon resin coated paper stock produces a photographic element suitable for direct reflection viewing. Resin coated paper stock represents only one type of material upon which this type of sensitized material may be coated.

We have produced an example of materials in Example 1 in which the support is a clear about 0.18 mm polyester base. This material is suitable for backlit display viewing where the display box contains a light and a translucent diffuser.

Polyester base sheet support thickness can be varied to meet the need of the particular application. Typically, supports of this nature are about 0.10 to 0.18 mm of thickness. Other clear supports such as acetate or cellulose nitrate may also be used.

Other examples of applications where a clear support would be necessary are X-ray films, motion picture films, motion picture intermediate films, slide films, etc.

Example 17

In some applications, the print display box does not contain a translucent diffuser over the light. For applications such as these, a light diffusing layer is coated between the clear photographic support of Example 16 and the sensitized layers of the element. The diffusing layer consists of a mixture of gelatin and titanium dioxide particles whose thickness and concentration are adjusted to provide a minimum density without becoming so translucent as to reveal the back lighting of the display box.

Example 18

A second type of support, commercially available from DuPont, is known as Melinex TM. This material is a diffuse reflective support comprised of a voided polyester filled with barium sulfate particles. It was sensitized with the element described above in Example 1 and produced a black and white print.

Other support types could have included films made from polyvinyl acetate, polyvinyl chloride, polyethylene, polycarbonate, polystrene, cellulose nitrate, etc. For completeness, biaxially oriented and voided polypropylene or polyethylene supports as well as paper fiber supports which include materials known to act as water vapor or oxygen barrier layers. In the instance of oxygen barriers, it is well known that polyvinyl alcohol is highly effective.

Color Development Process Modification Requirement For Examples 16–18 Elements:

When sensitizing a support which is transparent, it is necessary to increase the coverage of the sensitizing materials such as the coupler dispersions and the silver halide. Normally it is required to approximately double the coverage of the emulsions and dispersions compared to a reflective support in order to achieve a sufficiently high enough Dmax and contrast. This requires that approximately twice as much silver halide be developed than in the standard color development processing step.

We have learned that in the standard 45 second color development step, that insufficient color developer can diffuse into the element in time to react with the developing silver halide. The solution to this problem is to increase the development time (and also the bleach-fix time) to approximately twice the normal time. With this minor process modification, contrast and $D_{max}$ densities are substantially higher than with the standard color development time and are judged adequate for direct transmission viewing.

Example 19: Development of an Exceptionally Low Silver Halide Containing Paper

An example of an element has been produced wherein the amounts of silver halide have been substantially reduced. In this example the amounts of red, green and blue silver halide coated are shown in Table 4 below compared to the levels used in Example 1.

TABLE 4

Comparison of Silver Halide Levels in Standard RA4 Color Development Process vs. a Development-Amplifier Process

| | Example 1 RA-4 Process Nominal Silver Coverage (mg/M2) | Developer-Amplifier Process Nominal Silver Coverage (mg/M2) |
|---|---|---|
| Red | 352. | 86.7 |
| Green | 188. | 34.1 |
| Blue | 70.4 | 15.5 |

The key to the substantial reduction in the amount of silver halide coated, is the used of the 'developer-amplifier' solution in place of the standard color developer bath. The developer-amplifier solution contains hydrogen peroxide. The presence of the hydrogen peroxide allows the re-use of the developed silver halide by acting as an electron transfer agent between the developed silver and the color developer, thus resulting in a substantially reduced need for developed silver.

The formula used for the developer-amplifier solution is given below in Table 5.

TABLE 5

Developer-Amplifier Solution Composition

| Component | Concentration g/liter |
|---|---|
| Kodak Color Developer CD-3 (Methane sulfonamide, N-[2-(4-amino-3-methylphenyl)-ethylamino]ethyl]-sulfate) | 3.50 |
| Hydrogen peroxide | 50.0 cc of a 3.0% aqueous solution |
| Potassium bromide | 0.001 |
| Potassium chloride | 0.50 |
| Potassium carbonate | 25.0 |
| Kodak anti-calcium #5 (Dequest 2010) (1-hydroxyethyl-1,1-diphosphonic acid 60%) | 0.60 |
| Kodak anti-calcium #8 (diethylenetriamine-pentaacetic acid penta sodium salt 40%) | 2.0 cc |
| N,N-diethylhydroxyl amine (85%) | 4.0 cc |
| Adjust to pH = 10.3 with potassium hydroxide or sulfuric acid | |

TABLE 6

Processing Sequence and Times

| Process Step | Time |
|---|---|
| Develop-amplify | 45 seconds |
| Bleach-fix | 45 seconds |
| Wash | 90 seconds |

Processing temperature is 90° F.

Examples 20–23: Addition of an Antioxidant to the Dispersion Oil Phase to Reduce Printout It is widely known that upon exposure to light photographs fade. The degree of fade is proportional to the type of photographic image (silver vs. pigmented vs. dye), the intensity of light and the wavelength of light. In some photographic images, areas where there is no image (known as D-min) are also discolored. This discoloration is predominantly due the formation of a yellow stain. The yellow stain is known as 'print-out'. Various additives and treatments are usually employed to reduce or minimize this stain build-up upon prolonged exposure to light.

Among the more effective stain preventers used in color photographs using dye images are the class of antioxidants known as hydroquinones. Inclusion of a hydroquinone into the oil phase of the coupler dispersion serves to act as an antioxidant and significantly reduces the yellow stain build-up upon prolonged exposure to light.

We have found that inclusion of such a hydroquinone into the dispersion oil phase significantly reduces the formation of print-out during exposure to light. Table 7 below shows the reduction in print-out obtained when samples of the photographic element formed in Example 1 are exposed to 2 weeks of 50 klux sunshine.

TABLE 7

Printout Reduction as A Function of Antioxidant Level

| Example | Weight Fraction of Antioxidant in the Dispersion | Print-out After 2 Weeks of 50 Klux Sunshine Exposure Change in Blue $D_{min}$ Density |
|---|---|---|
| 20 | 0.000 | 0.08 |
| 21 | 0.013 | 0.05 |
| 22 | 0.026 | 0.03 |
| 23 | 0.052 | 0.00 |

In the Examples 20–23 above, the hydroquinone chosen is 1,4-benzenediol, 2,5-di-sec-dodecyl. The data in Table 7 clearly shows how the inclusion of the hydroquinone antioxidant reduces the amount of printout formed during exposure to light. It should also be noted that hydroquinones other than the example shown above would be equally as effective.

Examples 23A-G: Addition of a Hydrophobic Polymer to Reduce the Sensitivity to Leuco Dye Formation in the Bleach Fix It is widely known that cyan dyes formed in the chromogenic development process have electrolytic reduction potentials low enough to make the dye susceptible to leuco cyan dye formation if the oxidation potential of the bleach-fix (blix) falls below a certain minimum threshhold. The susceptibility of the dye to reduction is a function of the concentration of ferrous ion in the blix, the pH of the blix and the hydrophobicity of the dispersion in which the cyan dye was formed.

Leuco cyan dye formation usually is not a problem in the development process, unless the blix becomes exhausted and is under-replenished. When the blix is under-replenished, the amount of ferrous ion generated as the ferric ion oxidizes the developed silver to form silver bromide, increases to a level where significant leuco cyan dye formation may occur. This leuco cyan dye formation is undesirable since it results in the apparent reduction of cyan contrast in the print which affects color reproduction.

In the instance of a chromogenically formed neutral print such as described in this application, the result is an image which appears red in color since it is lacking in the desired cyan dye amount.

In order to reduce this sensitivity to leuco cyan dye formation, we have found that the addition of a hydrophobic polymer, such as poly-t-butyl acrylamide, to the oil phase of the chromogenic dispersion, results in a balanced neutral dye image which is substantially reduced in leuco cyan dye sensitivity.

Table 7A, shown below, gives the dispersion formulations used to test the invention:

TABLE 7A

Measurement of the Leuco Cyan Dye Sensitivity of the Chromogenic Dispersion

| Example | Couplers Used in Chromogenic Dispersion: Cyan | Magenta | Yellow | Polymer Ratio[1] | Change in Cyan Dye Density from Dr = 1.0 |
|---|---|---|---|---|---|
| 23A | A | B | C8 | 0.44 | −0.093 |
| 23B | A | B | C5 | 0.44 | −0.057 |
| 23C | A | B | C | 0.44 | −0.054 |
| 23D | A | B | C8 | 0.66 | −0.099 |
| 23E | A | B | C5 | 0.66 | −0.071 |
| 23F | A | B | C | 0.66 | −0.034 |
| 23G | A5 | B | C5 | 0.44 | −0.031 |
| Reference | A | B | C | 0.00 | −0.131 |

[1]Ratio of poly-t-butyl acrylamide polymer to yellow coupler in the chromogenic dispersion.

It is seen in Table 7A that the inclusion of the polymer, poly-t-butylacrylamide to a variety of dispersions effectively and surprisingly, reduces the sensitivity of the processed coat to the formation of leuco cyan dye.

Description of the Procedure Used to Perform the Leuco Cyan Dye Test:

The chromogenic dispersion was prepared as described earlier. Where required, the polymer, poly-t-butyl acrylamide, is added to the oil phase of the dispersion in the ratios described in the Table 7A above. Once the dispersion was prepared, it was coated, using standard coating techniques onto resin coated color paper stock with an amount of silver halide.

After the coating is prepared, it is exposed and processed as described earlier. Using an X-rite densitometer, the area of the coating having-a status A density of 1.0 is determined and marked. The coating is then immersed in a reducing bath of ferrous sulfate for 5 minutes. After rinsing in distilled water and drying, the density of the sample is re-measured and the change in density from Dr=1.0 calculated by difference from the original sample.

A ferrous sulfate bath, such as that described below, simulates the chemistry of an exhausted bleach-fix bath where the bleach (ferric ion) has been reduced by developed silver to ferrous ion, which is known as a powerful reducing agent.

The ferrous sulfate bath used to treat the samples is prepared by dissolving 41.8 g of tetra-sodium-ethylenediaminetetraacetic acid (EDTA) in 1.0 L of distilled water, then adjusting the pH to 4.0 with a 10% solution of nitric acid. The solution is then deoxygenated by bubbling nitrogen through it for 15 minutes. Then 15.2 g of ferrous sulfate (heptahydrate) is added with stirring. The pH of the solution is then raised to 5.0 with dilute ammonium hydroxide.

Examples 24–27: Simplification of the Coating Structure

An inefficiency exists in structure 1, in that a relatively large amount of the chromogenic coupler dispersion is required in order that the neutrality of the higher density areas of the print remain a 'neutral' color balance. If a excess of coupler is not present, competition between the mixed couplers for the oxidized color developer becomes out of balance. The result of this in%-balance of competition means that one coupler is more reactive than the other two; hence producing more of one dye and biasing the neutrality of the higher density areas of the print to the color of the dye formed in excess. This is undesirable since it is required that the hue of the image remain constant throughout the range of densities produced in the print.

The effect of reducing the amount of dispersion is illustrated in Table 8. As the coverage of the chromogenic coupler dispersion coated in the red sensitive layer is sequentially reduced from the normal amount (100% level) to 25% of that amount, it is observed that the colorimetric terms, a* and b*, which describe the hue or color of the print, measured at a Status A density near 1.0 undergo only small changes of 1.2 units and 1.5 units respectively. This small change in color is near the sensitivity threshold of color vision which is generally estimated to be near +/−1.0 a* or b* unit and therefore are undetectable to the eye.

At higher Status A densities (density 1.7 for example) the values of a* and b* change by 9.1 and 2.6 units respectively as the amount of chromogenic dispersion is reduced from the standard amount to 25% of that amount. This change in color as exemplified by the changes in a* and b* is significantly greater than +/−1.0 a* or b*, is clearly visible to the eye and renders the resultant print 'non-neutral' as the a* and b* values differ significantly from zero. In this instance, as the chromogenic dispersion coverage is reduced, the a* value moves in a negative direction, the b* value moves in a positive direction and the viewer observes the print changing from slightly red to green as the density of the print increases. These results show that it is not possible to reduce the amount of chromogenic dispersion coated in the red sensitive layer without compromising the desired neutral hue of the print across the range of desired densities.

TABLE 8

Effect of Reducing the Chromogenic Dispersion Coverage on Colorimetry

| | | Density 1.0 +/− 0.2 | | Density 1.7 +/− 0.3 | |
|---|---|---|---|---|---|
| Example | Dispersion Coverage | a* | b* | a* | b* |
| 24 | 25% | 3.5 | −1.5 | −4.4 | −0.2 |
| 25 | 50% | 4.4 | −2.3 | 0.4 | −1.6 |
| 26 | 75% | 4.2 | −2.4 | 3.7 | −2.3 |
| 27 | 100% | 4.7 | −3.0 | 4.7 | −2.8 |
| | Difference (100% − 25%) | 1.2 | −1.5 | 9.1 | −2.6 |

In Structure 2, the three spectrally sensitized layers have been combined into a single layer.

Table 9 illustrates the colorimetric data for the same density areas of a print as those values given in Table 8. As in Table 8, it is seen that at densities near 1.0, the values of a* and b* are similar and near zero indicating neutrality. In this example, however, there is a color shift as a* became more positive (red) and b* became more negative (blue). This color shift renders the print non-neutral by definition. It is possible to adjust the colorimetry of the element to true neutrality by reformulating the chromogenic dispersion oil phase by slightly adjusting the relative amounts of cyan magenta and yellow dye forming couplers.

TABLE 9

Effect on Colorimetry Of Combining Red, Green, and Blue Sensitized Layers Into One Sensitized Layer (Structure 2)

| | | Density 1.0 +/− 0.2 | | Density 1.7 +/− 0.3 | |
|---|---|---|---|---|---|
| Structure | Dispersion Coverage | a* | b* | a* | b* |
| 2 | 100% | 1.0 | 2.0 | 4.5 | −2.5 |

Examples 28–31: Addition of a Gelatin Sublayer (Control)

Structure 3 is described which differs from Structure 2 by the addition of a gelatin sub-layer placed underneath the sensitized layer. Comparison of the colorimetric data given in Table 9 vs. the standard dispersion coverage coating in Table 10 illustrates that these structures are comparable for color at equal dispersion coverage. In Structure 3, we observe that the reduction of chromogenic dispersion coverage from the standard position to one 75% lower not only improves the neutrality of the print at densities near 1.0, but reduces the tendency of the print to undergo a color shift at high densities as was shown in Table 1. The change in a* at high densities is reduced from 9.1 to 5.0 and b* from 2.6 to 1.9 units.

Structure 3

| Layer | Material | Coverage (mg/M2) |
|---|---|---|
| Overcoat | gelatin | 1345.0 |
| | N | 21.5 |
| | D | 64.6 |
| | Alkanol-XC | 21.5 |
| UV Absorber | gelatin | 1398.8 |
| | Tinuvin 326 | 113.0 |
| | Tinuvin 328 | 640.2 |
| | N | 75.2 |
| Red, Green and Blue Sensitive Layer | gelatin | 3509.5 |
| | Red sensitive silver halide | 351.7 |
| | Green sensitive silver halide | 187.7 |
| | Blue sensitive silver halide | 70.4 |
| | Cyan coupler (A) | 997.6 |
| | Magenta coupler (B) | 526.1 |
| | Yellow coupler (C) | 1173.1 |
| | Stabilizer (L) | 390.0 |
| | Coupler Solvent (D) | 1172.1 |
| | Aux. Solvent (E) | 1107.3 |
| Color correcting Underlayer | Gelatin | 1076.0 |
| Resin Coated Support | | |

TABLE 10

Effect on Colorimetry of Adding a Gelatin Sub-layer

| | | Density 1.0 +/− 0.2 | | Density 1.7 +/− 0.3 | |
|---|---|---|---|---|---|
| Example | Dispersion Coverage | a* | b* | a* | b* |
| 28 | 25% | −0.1 | 1.0 | −1.0 | −0.5 |
| 29 | 50% | 0.5 | 0.3 | 3.7 | −1.9 |
| 30 | 75% | 1.3 | −0.5 | 4.0 | −2.1 |
| 31 | 100% | 1.6 | −0.9 | 4.0 | −2.4 |
| | Difference (100% vs. 25%) | 1.7 | −1.9 | −5.0 | −1.9 |

Examples 32–35: Addition of a Color Correcting Coupler to the Sub Layer (Invention)

Structure 4 shows the addition of a color correcting coupler to the underlayer illustrated in Structure 3. In this instance, since the higher density areas of the print become increasingly green as the coverage of chromogenic dispersion is reduced, we have chosen to add a dispersion containing a magenta coupler (B). The function of this color correcting coupler, is to react with oxidized color developer diffusing from the imaging layer above to form the complementary dye hue required to compensate for the imbalance in coupler reactivity in the imaging layer thus forming an overall neutral image. Since this dye formation reaction takes place only in area of the print receiving high exposure, the hue adjustment in the print is selective to the higher density areas.

Structure 4

| Layer | Material | Coverage (mg/M2) |
|---|---|---|
| Overcoat | gelatin | 1345.0 |
| | N | 21.5 |
| | D | 64.6 |
| | Alkanol-XC | 21.5 |
| UV Absorber | gelatin | 1398.8 |
| | Tinuvin 326 | 113.0 |
| | Tinuvin 328 | 640.2 |
| | N | 75.2 |
| Red, Green and Blue Sensitive Layer | gelatin | 3509.5 |
| | Red sensitive silver halide | 351.7 |
| | Green sensitive silver halide | 187.7 |
| | Blue sensitive silver halide | 70.4 |
| | Cyan coupler (A) | 997.6 |
| | Magenta coupler (B) | 526.1 |
| | Yellow coupler (C) | 1173.1 |
| | Stabilizer (L) | 390.0 |
| | Coupler Solvent (D) | 1172.1 |
| | Aux. Solvent (E) | 1107.3 |
| Color correcting Underlayer | Gelatin | 1076.0 |
| | Magenta coupler (B) | 53.8 |
| | Stabilizer (L) | 39.9 |
| | Coupler Solvent (D) | 26.9 |
| | Stabilizer (N) | 5.4 |
| Resin Coated Support | | |

Table 11 gives the colorimetric data obtained from the examples given in Structure 4. This data shows that the addition of the magenta color correcting coupler has decreased the color shift from green to neutral as the amount of chromogenic dispersion coverage is decreased from the standard coverage (100%) to 25% of the standard coverage. The absolute change in a* is 0.3 units at densities near 1.0 and only 1.4 units at densities near 1.7. Changes in b* are even smaller and insignificant as is illustrated in Table 11.

TABLE 11

Effect on Colorimetry of Adding A Magenta Dye Forming Color Correcting Layer Aid in Dispersion Material Reduction

| | | Density 1.0 +/− 0.2 | | Density 1.7 +/− 0.3 | |
|---|---|---|---|---|---|
| Example | Dispersion Coverage | a* | b* | a* | b* |
| 32 | 25% | 1.4 | −0.2 | 2.6 | −2.8 |
| 33 | 50% | 1.1 | 0.0 | 4.6 | −2.4 |
| 34 | 75% | 1.6 | −0.6 | 4.5 | −2.5 |
| 35 | 100% | 1.7 | −0.8 | 4.0 | −2.5 |
| | Difference (100% − 25%) | 0.3 | −0.6 | 1.4 | 0.3 |

Examples 36–39: Addition of a Second Color Correcting Layer

Structure 5 illustrates a variation of structure 4. In addition to the color correcting underlayer containing the color correcting coupler (B), a second color correcting layer has been added, in this instance, above the imaging layer. This second color correcting layer also contains the magenta color correcting coupler.

Structure 5

| Layer | Material | Coverage (mg/M2) |
|---|---|---|
| Overcoat | gelatin | 1345.0 |
| | N | 21.5 |
| | D | 64.6 |
| | Alkanol-XC | 21.5 |
| UV Absorber | gelatin | 1398.8 |
| | Tinuvin 326 | 113.0 |
| | Tinuvin 328 | 640.2 |
| | N | 75.2 |
| Color Correcting Super Layer | gelatin | 1076.0 |
| | Magenta coupler (B) | 53.8 |
| | Stabilizer (L) | 39.9 |
| | Coupler Solvent (D) | 26.9 |
| | Stablizer (N) | 5.4 |
| Red, Green and Blue Sensitive Layer | gelatin | 3509.5 |
| | Red sensitive silver halide | 351.7 |
| | Green sensitive silver halide | 187.7 |
| | blue sensitive silver halide | 70.4 |
| | Cyan coupler (A) | 997.6 |
| | Magenta coupler (B) | 526.1 |
| | Yellow coupler (C) | 1173.1 |
| | Stabilizer (L) | 390.0 |
| | Coupler Solvent (D) | 1172.1 |
| | Aux. Solvent (E) | 1107.3 |
| Color Correcting Underlayer | gelatin | 1076.0 |
| | Magenta coupler (B) | 53.8 |
| | Stabilizer (L) | 39.9 |
| | Coupler Solvent (D) | 26.9 |
| | Stabilizer (N) | 5.4 |
| Resin Coated Support | | |

The colorimetric data generated from these coatings is shown in Table 12 below. Like that data shown in Table 11, the change in a* and b* values are small when comparing either high density values or when using this color correction technique.

TABLE 12

Effect on Colorimetry of Adding Two Magenta Dye Forming Color Correcting Layers to Aid in Dispersion Material Reduction

| | | Density 1.0 +/− 0.2 | | Density 1.7 +/− 0.3 | |
|---|---|---|---|---|---|
| Example | Dispersion Coverage | a* | b* | a* | b* |
| 36 | 25% | 0.9 | −0.4 | 4.1 | −3.9 |
| 37 | 50% | 1.2 | −0.4 | 5.0 | −3.2 |
| 38 | 75% | 1.3 | −0.7 | 4.3 | −2.7 |
| 39 | 100% | 1.9 | −1.1 | 4.2 | −2.8 |
| | Difference (100% − 25%) | 1.0 | −0.7 | 0.1 | 1.1 |

It should be readily apparent that this invention is not limited to the application described above. Listed below, are examples of other photographic systems where the ability to produce a black-and-white image which does not contain silver are of utility and advantageous:

1) Producing black-and-white motion picture print film. Producing black-and-white motion picture print film on an acetate or polyester base that prints from color negative products can be printed onto using current motion picture printing technology. There currently is not a black-and-white motion picture print film on the market. This would allow contrast manipulation in the printing stage rather than the processing stage as is currently done, by regulating the ratio of the red, green, and blue sensitive layers independently. It would also allow the color timers the possibility of making scene-to-scene contrast changes in the printing stage similar to the way they currently make scene-to-scene color timing. This is not possible currently.

2) Producing black-and-white motion picture intermediate film. It would be extremely useful in the special effects industry and would provide much greater flexibility in creating burn-in mattes, and holdout mattes.

3) Producing a black-and-white display film for backlighting applications.

4) Producing X-ray film from which all the silver is recovered.

5) Producing a masking film.

6) Producing a motion picture sound track film.

7) A black-and-white layer incorporated into a color negative film in a very slow emulsion layer for detail enhancement.

8) Increasing exposure latitude in a color print by using the neutral image forming dispersion in a layer adjacent to one or more color layers such as described in U.S. Pat. No. 4,946,765 (P. Hahm, Eastman Kodak Co.).

These and other variations of the invention are within the scope of the invention disclosed herein.

The invention has been described in detail with particular reference to preferred embodiments thereof, but it will be understood that variations and modifications can be effected within the spirit and scope of the invention.

We claim:

1. A photographic element comprising a support having thereon at least one imaging layer comprising at least one silver halide emulsion with grains sensitized with one color and balanced cyan, magenta and yellow dye forming couplers, and at least one color correcting layer consisting essentially of at least one dye forming coupler and gelatin.

2. The photographic element of claim 1 wherein said color correcting layer is adjacent to at least one imaging layer comprising at least one of, blue sensitized silver halide grains which are only sensitized to blue light, and green sensitized silver halide grains which are only sensitized to green light, in combination with neutral balanced cyan, magenta, and yellow dye forming couplers.

3. The element of claim 2 wherein the balanced couplers are not balanced at high density and said color correcting layer provides increased density.

4. The element of claim 1 wherein said coupler in said color correcting layer comprises a magenta dye forming coupler.

5. The element of claim 2 wherein said at least one imaging layer comprises magenta, cyan, and yellow dye forming couplers and red, blue, and green sensitized silver halide.

6. The element of claim 4 wherein said color correcting layer further comprises yellow dye forming coupler and cyan dye forming coupler.

7. The element of claim 1 wherein said color correcting layer is adjacent to at least one imaging layer comprising balanced magenta, cyan, and yellow dye forming couplers and red sensitized silver halide grains, green sensitized silver halide grains, and blue sensitized silver halide grains.

8. The element of claim 7 wherein said balanced dye forming couplers are balanced to form black and white images.

9. The element of claim 2 wherein said color correcting layer provides improved high densities in the developed element.

10. A photographic element comprising at least one imaging layer comprising at least one layer of neutral balanced cyan, magenta, and yellow dye forming couplers with blue sensitized silver halide grains which are only sensitized to blue light, and at least one layer Of balanced cyan, magenta, and yellow dye forming couplers with green sensitized silver halide grains which are only sensitized to green light, and adjacent to said at least one imaging layer a color correcting layer consisting essentially of gelatin and at least one dye forming coupler that forms at least one dye that compliments the color formed in said at least one imaging layer to produce a desired high density color and wherein said silver halide is sensitized with one color.

11. The element of claim 10 wherein there is one imaging layer and said imaging layer comprises red sensitized, blue sensitized, and green sensitized silver halide.

12. The element of claim 10 wherein there are at least three imaging layers, at least one layer comprising balanced cyan, magenta, and yellow dye forming couplers and red sensitized silver halide, at least one layer of balanced magenta, cyan, and yellow dye forming couplers and blue sensitized silver halide, and at least one layer of balanced magenta, cyan, and yellow dye forming couplers and green sensitized silver halide.

13. The element of claim 12 wherein said balanced dye forming couplers are balanced to form a black and white image.

14. The element of claim 12 wherein said element after exposure and development forms a black-and-white image.

15. A photographic element comprising a color correcting layer adjacent a balanced layer of magenta, cyan, and yellow couplers wherein said color correcting layer comprises a dye forming color correcting coupler that functions to increase the higher densities of the color formed by said color correcting coupler.

16. The element of claim 1 wherein said color correcting layer adjusts tone and lightness.

* * * * *